US007965972B2

(12) United States Patent
Ichikawa et al.

(10) Patent No.: US 7,965,972 B2
(45) Date of Patent: Jun. 21, 2011

(54) IMAGE FORMING APPARATUS, POWDER TRANSPORTING APPARATUS AND WASTE-POWDER TRANSPORTING METHOD

(75) Inventors: Tomoya Ichikawa, Ebina (JP); Yoji Yamaguchi, Ebina (JP); Mihoko Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 179 days.

(21) Appl. No.: 12/388,120

(22) Filed: Feb. 18, 2009

(65) Prior Publication Data

US 2010/0080638 A1 Apr. 1, 2010

(30) Foreign Application Priority Data

Sep. 26, 2008 (JP) ..... 2008-247592

(51) Int. Cl.
*G03G 21/00* (2006.01)

(52) U.S. Cl. ..... 399/358; 399/360

(58) Field of Classification Search ..... 399/358–360
See application file for complete search history.

(56) References Cited

U.S. PATENT DOCUMENTS

| | | | | |
|---|---|---|---|---|
| 7,103,308 | B2 * | 9/2006 | Wakana | 399/358 |
| 2005/0058475 | A1 | 3/2005 | Tsurusaki | 399/358 |
| 2005/0169649 | A1 | 8/2005 | Onodera et al. | 399/35 |
| 2006/0216086 | A1 * | 9/2006 | Yuasa et al. | 399/358 |

FOREIGN PATENT DOCUMENTS

| | | |
|---|---|---|
| JP | 57-122472 A | 7/1982 |
| JP | 63-002091 | 1/1988 |
| JP | 5-289584 A | 11/1993 |
| JP | 07-175390 | 7/1995 |
| JP | 2005-49689 | 2/2005 |
| JP | 2005-242274 | 9/2005 |

* cited by examiner

*Primary Examiner* — Hoang Ngo

(74) *Attorney, Agent, or Firm* — Morgan, Lewis & Bockius LLP

(57) ABSTRACT

An image forming apparatus includes: an image forming section forming an image on a recording medium; first and second storage parts storing waste powder discarded from the image forming section; a transport path of the waste powder; first and second discharging parts provided on the transport path and discharging the waste powder to the first and second storage parts, respectively; a transporting section provided along the transport path between both discharging parts, and transporting the waste powder toward the second and first discharging parts in first and second operating states, respectively; a feeding section feeding the waste powder from the image forming section to the transport path between both discharging parts; and a controller making the transporting section operate in both operating states, and stopping the feeding section or reducing its output when switching a transporting direction of the waste powder by switching from the first to second operating state.

11 Claims, 8 Drawing Sheets

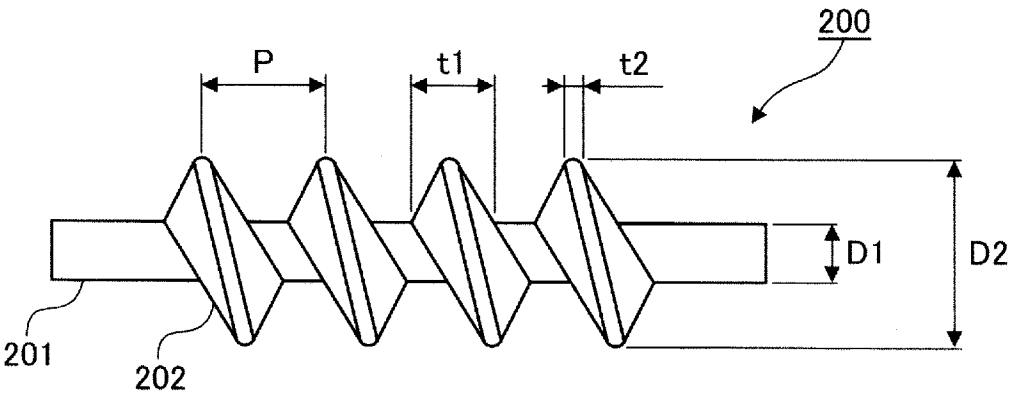
FIG.8A
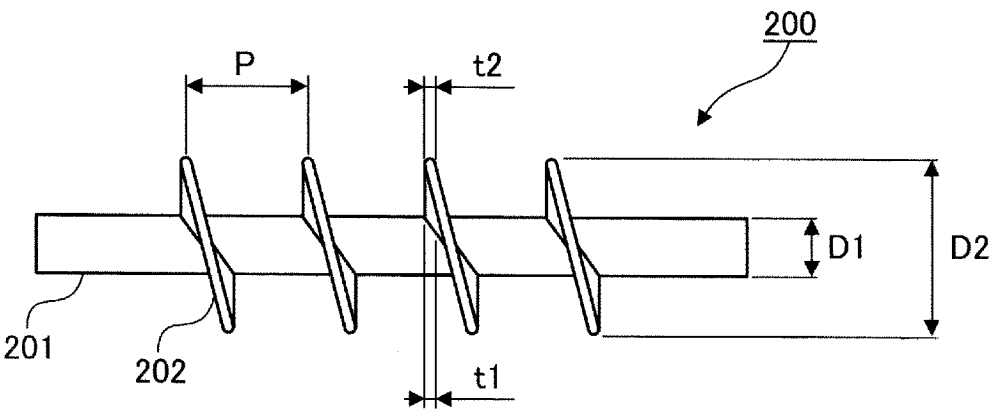
FIG.8B
$$\text{VOLUME OF TRANSPORTED WASTE TONER} = \left\{\left(\frac{D2}{2}\right)^2 \pi - \left(\frac{D1}{2}\right)^2 \pi\right\} \times \left\{P - \frac{t1 + t2}{2}\right\} \times \text{ROTATIONAL SPEED}$$
FIG.8C

IMAGE FORMING APPARATUS, POWDER TRANSPORTING APPARATUS AND WASTE-POWDER TRANSPORTING METHOD

CROSS REFERENCE TO RELATED APPLICATIONS

This application is based on and claims priority under 35 USC §119 from Japanese Patent Application No. 2008-247592 filed Sep. 26, 2008.

BACKGROUND

1. Technical Field

The present invention relates to an image forming apparatus, such as a copying machine and a printer, a powder transporting apparatus and a waste-powder transporting method.

2. Related Art

For image forming apparatuses, the following method has been proposed in order to shorten a time during which an image forming apparatus is stopped when a recovery container is filled up with a toner, for example. In this method, the image forming apparatus is provided with a recovery container having small capacity as well as a recovery container having large capacity that is disposed below the recovery container having small capacity, and these recovery containers are alternately used.

SUMMARY

According to an aspect of the present invention, there is provided an image forming apparatus including: an image forming section that forms an image on a recording medium; a first storage part that stores waste powder discarded from the image forming section; a second storage part that stores waste powder discarded from the image forming section; a transport path through which the waste powder is transported; a first discharging part that is provided on the transport path and that discharges, to the first storage part, the waste powder having been transported through the transport path; a second discharging part that is provided on the transport path and that discharges, to the second storage part, the waste powder having been transported through the transport path; a transporting section that is provided along the transport path so as to extend from the first discharging part to the second discharging part, the transporting section transporting the waste powder in the transport path toward the second discharging part when being in a first operating state, and the transporting section transporting the waste powder in the transport path toward the first discharging part when being in a second operating state; a feeding section that feeds the waste powder from the image forming section to the transport path at a location between the first discharging part and the second discharging part; and a controller that causes the transporting section to operate in one of the first operating state and the second operating state, and that stops the feeding section or reduces an output of the feeding section when switching a transporting direction of the waste powder by switching an operating state of the transporting section from the first operating state to the second operating state.

BRIEF DESCRIPTION OF THE DRAWINGS

Exemplary embodiment(s) of the present invention will be described in detail based on the following figures, wherein:

FIGS. 8A, 8B, and 8C are diagrams and an equation for describing the volume of the waste toner transported by the transporting member.

DETAILED DESCRIPTION

An exemplary embodiment of the present invention will be described in detail below with reference to the accompanying drawings.

Figure 1:
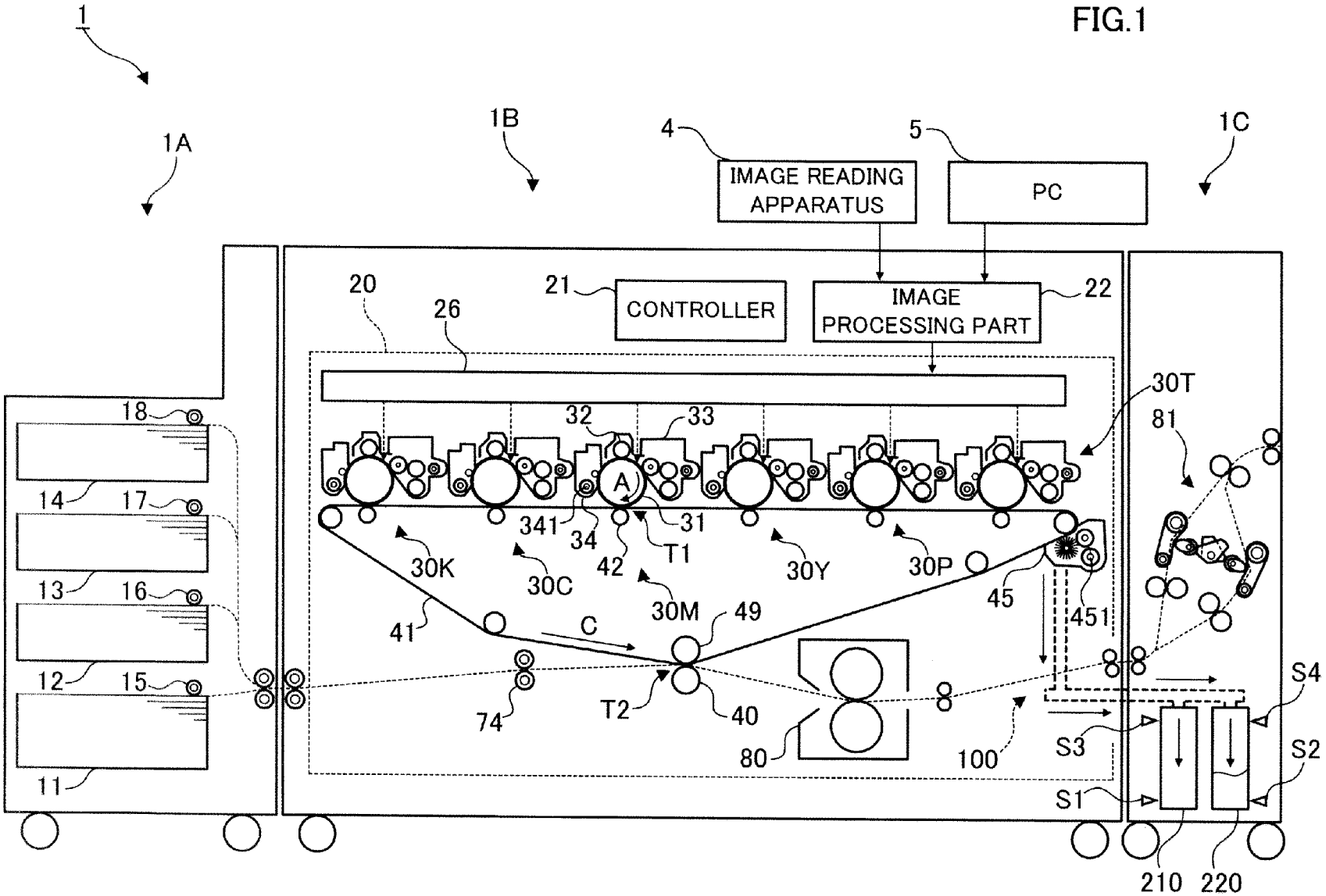
FIG. 1 is a diagram showing a configuration of a digital color printer as an example of an image forming apparatus.

FIG. 1 is a diagram showing a configuration of a digital color printer as an example of an image forming apparatus to which the exemplary embodiment is applied.

The image forming apparatus 1 of the present exemplary embodiment includes a sheet feeding unit 1A, an image formation unit 1B, and a sheet outputting unit 1C.

The sheet feeding unit 1A includes a first sheet storage part 11 to a fourth sheet storage part 14, each of which stores paper sheets serving as an example of a recording medium. The sheet feeding unit 1A further includes sending rolls 15 to 18 provided respectively for the first to fourth sheet storage parts 11 to 14. The sending rolls 15 to 18 send paper sheets stored in the respective sheet storage parts 11 to 14 to transport paths each connected to the image formation unit 1B.

The image formation unit 1B is of a so-called tandem type, and includes an image forming process part 20 (an example of an image forming section), a controller 21, and an image processing part 22. The image forming process part 20 forms an image on a paper sheet on the basis of image data of each color. The controller 21 controls the image forming process part 20 and the like. The image processing part 22 is connected, for example, to an image reading apparatus 4 and a personal computer (PC) 5, and performs image processing on image data received from these devices.

The image forming process part 20 includes six image forming units 30T, 30P, 30Y, 30M, 30C, and 30K (hereinafter, sometimes referred to simply as "image forming units 30") arranged in parallel at intervals. Each image forming unit 30 includes a photoconductor drum 31, a charging roll 32, a developing device 33, and a cleaning unit 34. An electrostatic latent image is formed on the photoconductor drum 31 while the photoconductor drum 31 is rotating in a direction indicated by an arrow A in the figure. The charging roll 32 electrically charges a surface of the photoconductor drum 31 uniformly. The developing device 33 develops the electrostatic latent image formed on the photoconductor drum 31. The cleaning unit 34 removes an untransferred toner and the like on the surface of the photoconductor drum 31. In addition, the image forming process part 20 is provided with a laser exposure device 26 that scans and exposes, with a laser beam, the photoconductor drums 31 of the respective image forming units 30T, 30P, 30Y, 30M, 30C, and 30K.

Here, all the image forming units 30 have almost the same configuration except for the toner stored in the respective developing devices 33. Yellow (Y), magenta (M), cyan (C), and black (K) toner images are formed in the image forming units 30Y, 30M, 30C, and 30K, respectively.

Meanwhile, in addition to the commonly-used four colors (normal colors), that is, yellow, magenta, cyan, and black, another image forming material is sometimes desired to be used in the forming of an image on a paper sheet. Specifically, there is a case where an image is desired to be formed on a paper sheet by using an image forming material, such as a spot color, that is difficult or impossible to be expressed with the commonly-used four colors. For example, an image is sometimes desired to be formed on a paper sheet by using a toner, such as a toner of a corporate color dedicated to a specific user, a foam toner for Braille, a fluorescent toner, a toner that improves a gloss, a ferromagnetic toner, an invisible toner having sensitivity to the infrared region, or the like. For this reason, the image formation unit 1B of the present exemplary embodiment is provided with image forming units 30T and 30P that achieve image formation using a spot color and the like, in addition to the generally-mounted image forming units 30Y, 30M, 30C, and 30K.

Moreover, the image forming process part 20 includes the intermediate transfer belt 41, primary transfer rolls 42, a secondary transfer roll 40, a belt cleaner 45, and a fixing device 80. Onto the intermediate transfer belt 41, various color toner images formed by the photoconductor drums 31 of the respective image forming units 30 are superimposedly transferred. The primary transfer rolls 42 sequentially transfer (primarily transfer) the various color toner images of the respective image forming units 30 onto the intermediate transfer belt 41 at a primary transfer portion T1. The secondary transfer roll 40 transfers (secondarily transfers) the superimposed toner images, which have been transferred onto the intermediate transfer belt 41, together onto a paper sheet at a secondary transfer portion T2. The belt cleaner 45 removes an untransferred toner and the like on the surface of the intermediate transfer belt 41. The fixing device 80 fixes a secondarily transferred image onto the paper sheet.

The image forming process part 20 performs an image forming operation on the basis of control signals sent from the controller 21. First, image data inputted through the image reading apparatus 4 or the PC 5 are subjected to image processing by the image processing part 22, and then supplied to the laser exposure device 26. Then, for example, in the magenta (M) image forming unit 30M, after the surface of the photoconductor drum 31 is uniformly charged with a potential set in advance, by the charging roll 32, the photoconductor drum 31 is scanned and exposed by the laser exposure device 26 with a laser beam modulated according to the image data acquired from the image processing part 22. In this way, an electrostatic latent image is formed on the photoconductor drum 31. The electrostatic latent image thus formed is developed by the developing device 33, so that a magenta toner image is formed on the photoconductor drum 31. In the same manner, yellow, cyan, and black toner images are formed respectively in the image forming units 30Y, 30C, and 30K, and also, toner images of spot colors or the like are formed respectively in the image forming units 30T and 30P.

These color toner images having been formed in the respective image forming units 30 are electrostatically transferred (primarily transferred) in sequence by the corresponding primary transfer rolls 42 onto the intermediate transfer belt 41 rotating in a direction indicated by an arrow C in FIG. 1, so that superimposed toner images are formed on the intermediate transfer belt 41.

On the other hand, the untransferred toner and the like remaining on each photoconductor drum 31 at the primary transfer are removed by the cleaning unit 34 disposed downstream of the primary transfer roll 42. Each cleaning unit 34 includes a transporting member 341 provided along an axial direction of the photoconductor drum 31. The transporting member 341 transports the removed untransferred toner and the like to a rear side (back part side) of the image formation unit 1B. The untransferred toner and the like (a waste powder) transported by the transporting member 341 to the rear side of the image formation unit 1B are then transported by a transporting mechanism 100 to a first storing container 210 (an example of a first storage part) or a second storing container 220 (an example of a second storage part). Here, the transporting mechanism 100 is provided also in the rear side of the image formation unit 1B, while the first and second storing containers 210 and 220 are both detachably and attachably provided in the sheet outputting unit 1C.

Here, in the present exemplary embodiment, two storing containers are provided. Specifically, the two storing containers are the first storing container 210 and the second storing container 220. Accordingly, for example, even if any one of the storing containers is filled up, this configuration allows an image forming operation to be continuously performed by transporting the untransferred toner and the like to the other one of the storing containers. Moreover, for example, this configuration also allows a reduction in weight of the storing container that contains the untransferred toner and the like therein when the storing container is detached, as compared with a configuration in which the untransferred toner and the like are stored in a single storing container having a large capacity.

In addition, in the present exemplary embodiment, a first sensor S1 and a second sensor S2 are provided. The first sensor S1 performs detection on the first storing container 210, while the second sensor S2 performs detection on the second storing container 220. In the present exemplary embodiment, a third sensor S3 is further provided. The third sensor S3 outputs a signal set in advance, when the untransferred toner and the like reach an upper portion of the first storing container 210 (when the first storing container 210 is filled up with the untransferred toner and the like). Furthermore, in the present exemplary embodiment, a fourth sensor S4 is provided. The fourth sensor S4 outputs a signal set in advance, when the untransferred toner and the like reach an upper portion of the second storing container 220 (when the second storing container 220 is filled up with the untransferred toner and the like).

Note that, although the first storing container 210 and the second storing container 220 are provided in the sheet outputting unit 1C in the present exemplary embodiment, these storing containers may be provided alternatively in the image formation unit 1B.

On the other hand, the superimposed toner images formed on the intermediate transfer belt 41 are transferred, according to the movement of the intermediate transfer belt 41, toward the secondary transfer portion T2 in which the secondary transfer roll 40 and a backup roll 49 are disposed. Meanwhile, the paper sheet is transferred to a position of a registration roll 74 after being taken out of, for example, the first sheet storage part 11 by the sending roll 15 and then passing through the transport path.

At the timing when the superimposed toner images are transported to the secondary transfer portion T2, the paper sheet is fed to the secondary transfer portion T2 from the registration roll 74. Then, the superimposed toner images are electrostatically transferred (secondarily transferred) together onto the paper sheet by the action of a transfer electric field formed between the secondary transfer roll 40 and the backup roll 49 at the secondary transfer portion T2.

Thereafter, the paper sheet having the superimposed toner images electrostatically transferred thereon is peeled from the intermediate transfer belt 41, and then, is transported to the fixing device 80. The unfixed toner images on the paper sheet having been transported to the fixing device 80 are subjected to a fixing process with heat and pressure by the fixing device 80 so as to be fixed onto the paper sheet. Then, the paper sheet having a fixed image formed thereon passes through a curl correcting part 81 provided in the sheet outputting unit 1C, and then, is transported to an outputted-sheet stacking unit (not shown in the figure).

On the other hand, the untransferred toner and the like remaining on the surface of the intermediate transfer belt 41 after the secondary transfer are removed by the belt cleaner 45, which is disposed in contact with the intermediate transfer belt 41, after the completion of the secondary transfer. The belt cleaner 45 includes a transporting member 451 that is provided to extend from the front side to the rear side of the image formation unit 1B, and that transports the untransferred toner and the like thus removed to the rear side of the image formation unit 1B. Then, the untransferred toner and the like transported to the rear side of the image formation unit 1B by the transporting member 451 are transported to the first storing container 210 or the second storing container 220 by the transporting mechanism 100. Note that, in the specification, the untransferred toner and the like transported from the cleaning unit 34 and the belt cleaner 45 to the transporting mechanism 100 are hereinafter referred to as a waste toner.

Subsequently, the transporting mechanism 100 will be described in detail.

Figure 2:
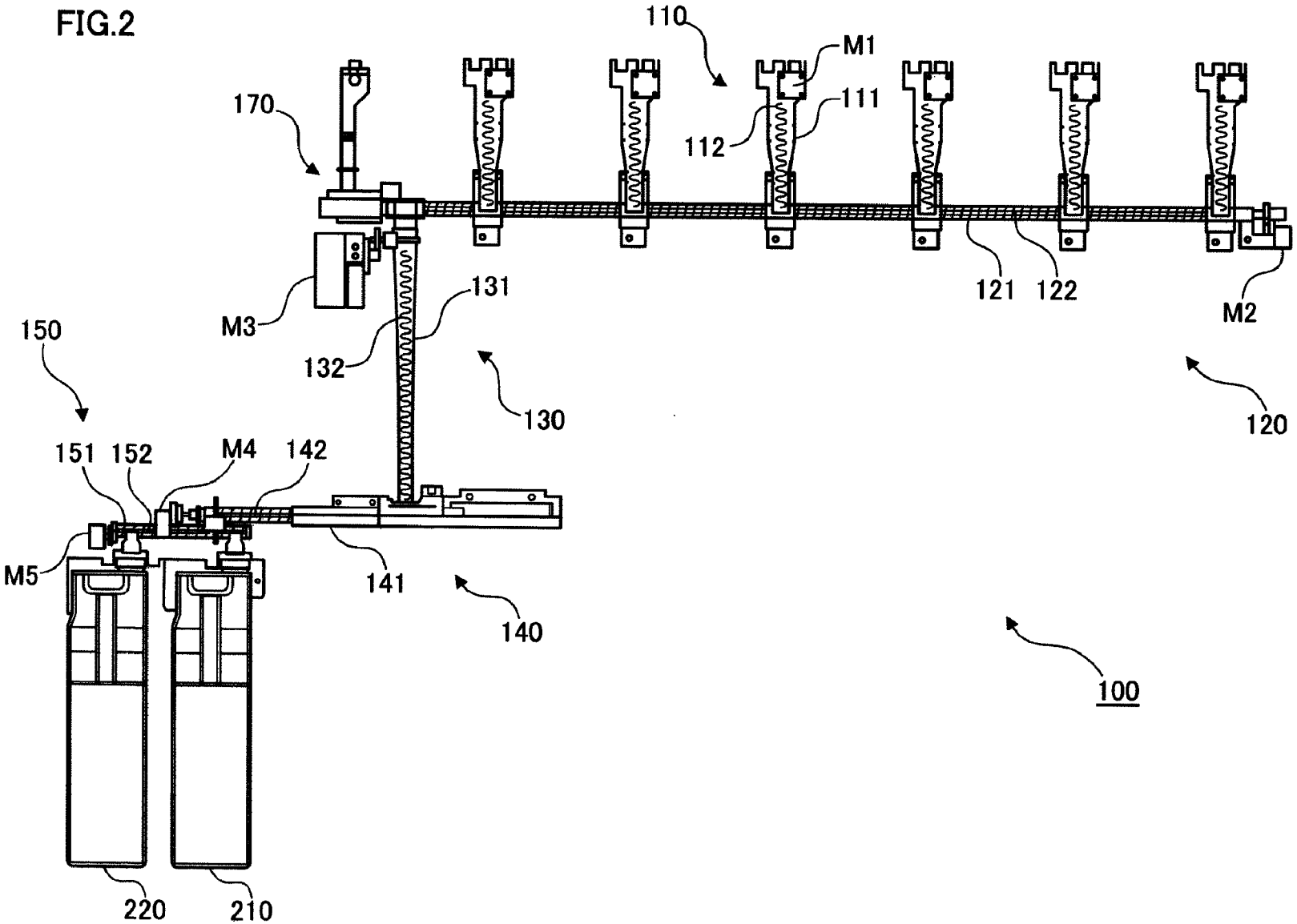
FIG. 2 is a diagram showing the transporting mechanism from the rear side of the image forming apparatus.

FIG. 2 is a diagram showing the transporting mechanism 100 from the rear side of the image forming apparatus 1.

As shown in FIG. 2, the transporting mechanism 100 includes first transporting mechanisms 110 that are provided corresponding to the respective image forming units 30, and that transport the waste toner (a waste powder) from the cleaning units 34. In addition, the transporting mechanism 100 includes a discharging part 170 to which the waste toner from the belt cleaner 45 is discharged. Moreover, the transporting mechanism 100 includes a second transporting mechanism 120, a third transporting mechanism 130, a fourth transporting mechanism 140, and a fifth transporting mechanism 150. The second transporting mechanism 120 transports the waste toner having been transported by the first transporting mechanisms 110 and the waste toner having been discharged from the discharging part 170. The third transporting mechanism 130 transports the waste toner having been transported by the second transporting mechanism 120. The fourth transporting mechanism 140 transports the waste toner having been transported by the third transporting mechanism 130, and the fifth transporting mechanism 150 transports, to the first storing container 210 or the second storing container 220, the waste toner having been transported by the fourth transporting mechanism 140.

Each first transporting mechanism 110 includes a tubular member 111, a coil spring 112, and a first motor M1. The tubular member 111 forms a transport path for the waste toner having been transported by the transporting member 341 (see FIG. 1) provided to the cleaning unit 34. The coil spring 112, which is an example of a breaking member, is provided inside the tubular member 111 and breaks down the waste toner adhering to an inner wall surface of the tubular member 111 by reciprocating along the tubular member 111. The first motor M1 rotationally drives the transporting member 341 and causes the coil spring 112 to reciprocate.

Each tubular member 111 is provided to extend in the up and down direction (the approximately vertical direction). Accordingly, the waste toner having been transported by the transporting member 341 falls down inside this tubular member 111.

Each coil spring 112 is formed of a wire, and has a helical (coil) shape. Specifically, each coil spring 112 does not have a rotational shaft unlike a transporting member 142 (see FIG. 4) having a rotational shaft 142A, which will be described later, and has a shape allowing the waste toner to pass through the center portion thereof. In other words, the shape of each coil spring 112 allows the waste toner to fall down in the tubular member 111. Each coil spring 112 is caused to reciprocate inside the tubular member 111 by the first motor M1 so as to break down the waste toner having set inside the tubular member 111 or to remove the waste toner from the inner wall of the tubular member 111.

The second transporting mechanism 120, functioning as a transporting section, includes a tubular member 121. The tubular member 121 is disposed to extend in an arrangement direction of the image forming units 30T, 30P, 30Y, 30M, 30C, and 30K (in the horizontal direction, approximately), is connected to the tubular members 111 and the discharging part 170, and forms a transport path for the waste toner. In addition, the second transporting mechanism 120 further includes the transporting member 122 and a second motor M2. The transporting member 122 is disposed inside the tubular member 121, and transports the waste toner having been transported from the first transporting mechanisms 110 and the waste toner having been discharged from the discharging part 170. The second motor M2 rotationally drives the transporting member 122. Incidentally, the transporting member 122 is configured similarly to the transporting member 142 and the transporting member 152 (see FIG. 4), both of which will be described later.

The third transporting mechanism 130 includes a tubular member 131 that is provided to extend in the up and down direction (the approximately vertical direction), that is connected to the tubular member 121, and that forms a transport path for the waste toner. In addition, the third transporting mechanism 130 includes a coil spring 132 and a third motor M3. The coil spring 132 is provided inside the tubular member 131, and is reciprocatable along the tubular member 131. The third motor M3 causes the coil spring 132 to reciprocate.

The tubular member 131 is provided to extend in the up and down direction (the approximately vertical direction). Accordingly, the waste toner having been transported by the second transporting mechanism 120 falls down inside this tubular member 131.

The coil spring 132 is formed of a wire, and also has a helical (coil) shape, as in the case of the coil spring 112. In addition, the coil spring 132 does not have a rotational shaft, and has a shape allowing the waste toner to pass through the center portion thereof, as in the above-described case. In other words, the shape of the coil spring 132 allows the waste toner to fall down in the tubular member 131. The coil spring 132 is caused to reciprocate inside the tubular member 131 by the third motor M3 so as to break down the waste toner having set inside the tubular member 131 or to remove the waste toner from the inner wall of the tubular member 131.

Figure 3:
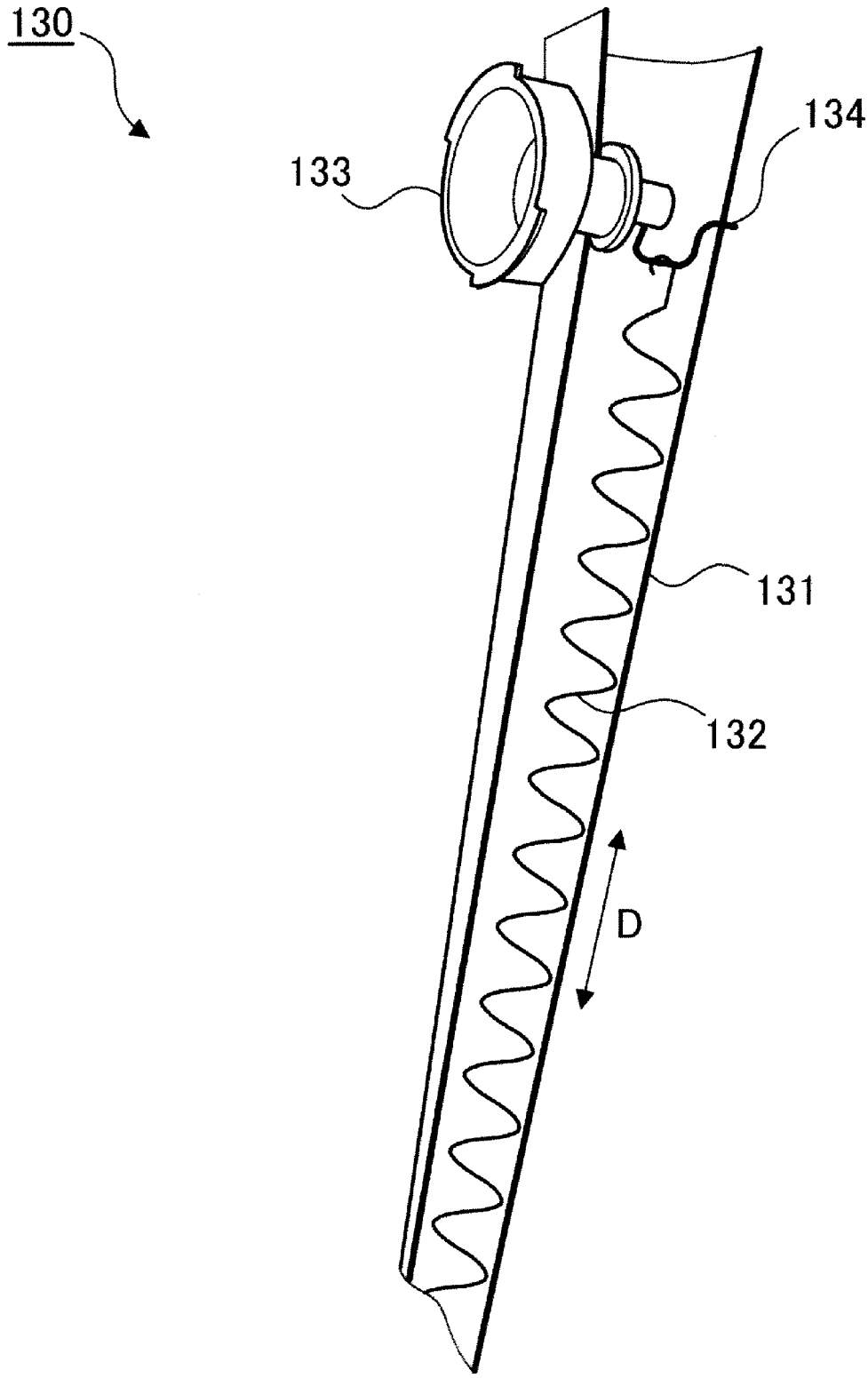
FIG. 3 is a diagram showing a reciprocation mechanism that causes the coil spring to reciprocate.

Note that, the reciprocation of the coil spring 132 is achieved by, for example, a configuration shown in FIG. 3.

Here, FIG. 3 is a diagram showing a reciprocation mechanism that causes the coil spring 132 to reciprocate. As shown in FIG. 3, the third transporting mechanism 130 includes a rotating member 133 and a driving member 134. The rotating member 133 is rotated by the third motor M3 (see FIG. 2).

One end portion of the driving member 134 is attached to the rotating member 133, while an upper end portion of the coil spring 132 is attached to the driving member 134. The driving member 134 is formed in a crank shape. In addition, the driving member 134 is configured so that an attachment portion thereof to which the coil spring 132 is attached passes a position eccentric to the center of the axis of the rotating member 133 when the third motor M3 is driven. Accordingly, once the third motor M3 is started to be driven, the coil spring 132 is caused to reciprocate along the tubular member 131 (see an arrow D) by the driving member 134. Note that, although a description has been omitted above, each of the coil springs 112 in the first transporting mechanisms 110 (see FIG. 2) is also caused to reciprocate by the same mechanism as that shown in FIG. 3.

Referring back to FIG. 2 again, the transporting mechanism 100 will be further described.

The fourth transporting mechanism 140 includes a tubular member 141 that forms a transport path for the waste toner. The tubular member 141 is disposed to intersect (to be orthogonal to) the tubular member 131 in the third transporting mechanism 130. In other words, the tubular member 141 is arranged to extend in the approximately horizontal direction. Moreover, the fourth transporting mechanism 140 includes a transporting member 142 that is disposed inside the tubular member 141, and that transports the waste toner from the third transporting mechanism 130. Further, the fourth transporting mechanism 140 includes a fourth motor M4 that rotationally drives the transporting member 142.

The fifth transporting mechanism 150 includes a tubular member 151 that forms a transport path for the waste toner. The tubular member 151 is disposed below the tubular member 141 in the fourth transporting mechanism 140, and also is arranged parallel to the tubular member 141. The fifth transporting mechanism 150 further includes a transporting member 152 and a fifth motor M5. The transporting member 152 is disposed inside the tubular member 151, and transports the waste toner from the fourth transporting mechanism 140. The fifth motor M5 rotationally drives the transporting member 152.

Figure 4:
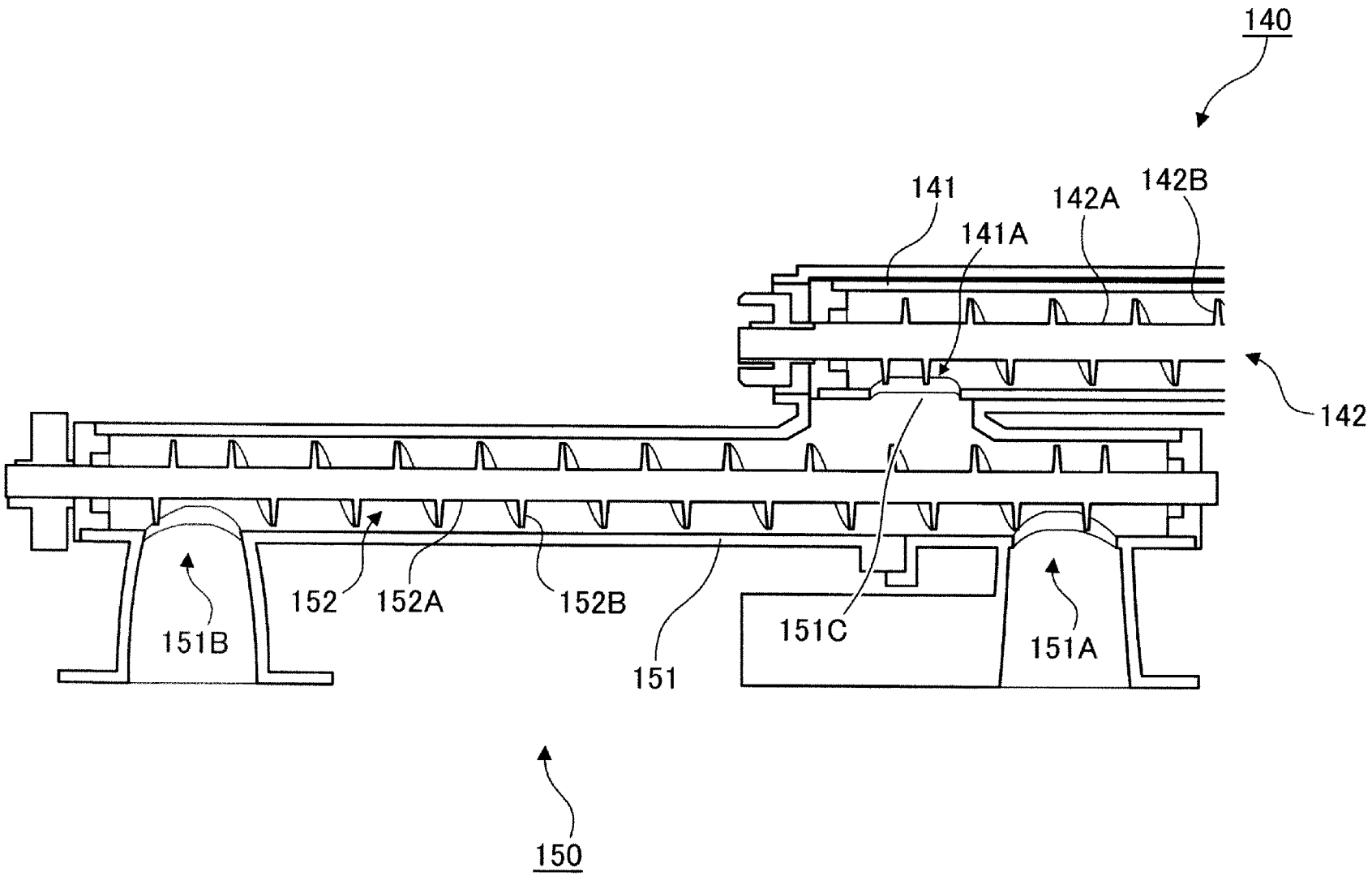
FIG. 4 is an enlarged diagram showing the fourth transporting mechanism and the fifth transporting mechanism.

Here, FIG. 4 is an enlarged view showing the fourth transporting mechanism 140 and the fifth transporting mechanism 150. With reference to FIG. 4, the fourth transporting mechanism 140 and the fifth transporting mechanism 150 will be further described.

The transporting member 142 in the fourth transporting mechanism 140 has one end and the other end, and includes: a rotational shaft 142A that is rotated by the fourth motor M4 (see FIG. 2); and ridge portions 142B each provided to project from an outer peripheral surface of the rotational shaft 142A. The ridge portions 142B are provided in the form of fins around the rotational shaft 142A, and also provided in a helical (screw) shape along the axis of the rotational shaft 142A.

In addition, the tubular member 141 in the fourth transporting mechanism 140 includes a discharge outlet 141A at a lower portion in an end portion on the fifth transporting mechanism 150 side. Through the discharge outlet 141A, the waste toner having been transported by the transporting member 142 is discharged to the tubular member 151 in the fifth transporting mechanism 150. Note that, the fourth transporting mechanism 140 in the present exemplary embodiment may be taken as a feeding section that feeds the waste toner to the transport path, which is formed by the tubular member 151, at a location between a first discharge outlet 151A (which will be described later) and a second discharge outlet 151B (which will be described later).

On the other hand, as is the case with the transporting member 142, the transporting member 152 in the fifth transporting mechanism 150 also has one end and the other end, and includes: a rotational shaft 152A that is rotated by the fifth motor M5 (see FIG. 2); and ridge portions 152B each provided to project from the rotational shaft 152A. The ridge portions 152B are provided in the form of fins around the rotational shaft 152A, and also provided in a helical (screw) shape along the axis of the rotational shaft 152A. Here, the transporting member 152, functioning as a transporting section, is provided along the transport path for waste toners formed by the tubular member 151. Moreover, the transporting member 152 is also provided to extend from the first discharge outlet 151A to the second discharge outlet 151B, both of which will be described later.

In addition, the tubular member 151 in the fifth transporting mechanism 150 includes a receiving port 151C (a receiving part) that receives the waste toner from the discharge outlet 141A in the fourth transporting mechanism 140 (the waste toner fed from the fourth transporting mechanism 140). Moreover, the tubular member 151 includes the first discharge outlet 151A (a first discharging part). Through the first discharge outlet 151A, the waste toner having been received by the receiving port 151C and transported by the transporting member 152 is discharged to the first storing container 210 (see FIG. 2). Furthermore, the tubular member 151 includes the second discharge outlet 151B (a second discharging part). Through the second discharge outlet 151B, the waste toner having been received by the receiving port 151C and transported by the transporting member 152 is discharged to the second storing container 220 (see FIG. 2).

Here, in the present exemplary embodiment, the first discharge outlet 151A is provided at a lower portion in one end portion of the tubular member 151, while the second discharge outlet 151B is provided at a lower portion in the other end portion of the tubular member 151. Meanwhile, the receiving port 151C is provided at an upper portion of the tubular member 151 between the first discharge outlet 151A and the second discharge outlet 151B.

Here, for example, when the fifth motor M5 (see FIG. 2) in the fifth transporting mechanism 150 is rotating in the forward direction, the forward rotation of the fifth motor M5 causes the transporting member 152 to be rotationally driven so as to transport the waste toner from the discharge outlet 141A to the second discharge outlet 151B. The waste toner thus transported to the second discharge outlet 151B falls down through the second discharge outlet 151B into the second storing container 220 located below the second discharge outlet 151B. Then, for example, if the second storing container 220 is filled up with the waste toner, the controller 21 causes the fifth motor M5 to rotate in the reverse direction. The reverse rotation of the fifth motor M5 causes the transporting member 152 to be rotationally driven in the reverse direction so as to transport the waste toner from the discharge outlet 141A to the first discharge outlet 151A. The waste toner thus transported to the first discharge outlet 151A falls down through the first discharge outlet 151A into the first storing container 210 located below the first discharge outlet 151A. In the present exemplary embodiment, the operating state of the transporting member 152 with the fifth motor M5 rotating in the forward direction may be taken as a first operating state, while the operating state of the transporting member 152 with the fifth motor M5 rotating in the reverse direction may be taken as a second operating state.

Meanwhile, when the fifth motor M5 is rotating in the reverse direction, the waste toner located between the receiving port 151C and the second discharge outlet 151B is caused to pass through a portion below the receiving port 151C. At the same time, the waste toner is successively discharged from the discharge outlet 141A. As a result, the waste toner is concentrated in a portion above or below the receiving port 151C, or in another portion, so that the clogging and the like of the waste toner may occur. In this regard, the controller 21 in the present exemplary embodiment carries out the following processing when reversing the rotation of the fifth motor M5 (when switching the transporting direction of the waste toner).

Figure 5:
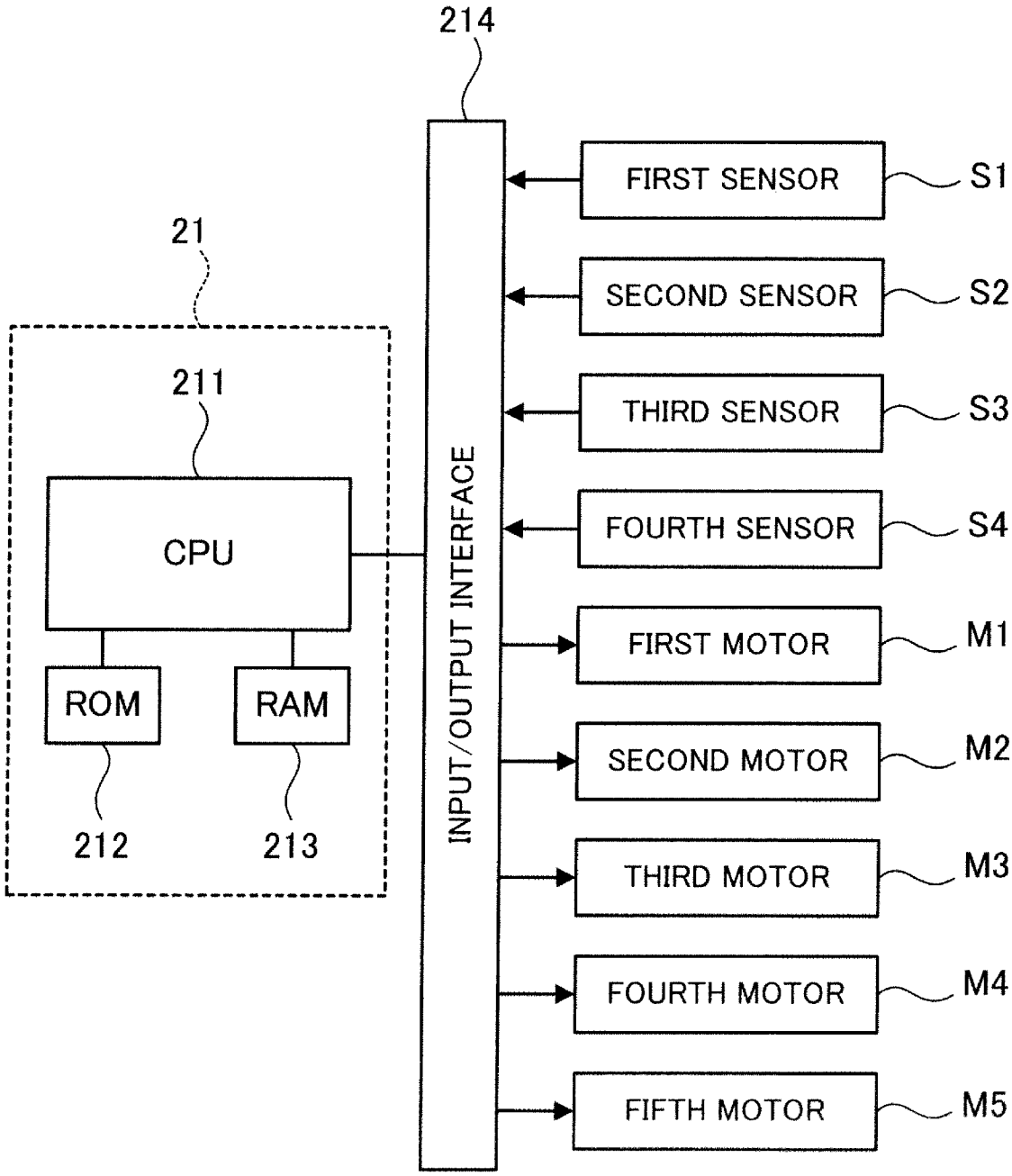
FIG. 5 is a diagram showing the control block of the controller.

FIG. 5 is a diagram showing the control block of the controller 21. Note that, FIG. 5 shows only the block concerning the transportation of the waste toner.

The controller 21 includes a central processing unit (CPU) 211, a read only memory (ROM) 212, and a random access memory (RAM) 213. The CPU 211 of the controller 21 performs processing described below while exchanging data with the RAM 213, in accordance with a program stored in the ROM 212.

Here, the controller 21 receives outputs from the first to the fourth sensors S1 to S4 via an input/output interface 214. In addition, the controller 21 controls the first to the fifth motors M1 to M5 via the input/output interface 214.

Subsequently, the processing performed by the controller 21 will be described in detail.

Figure 6:
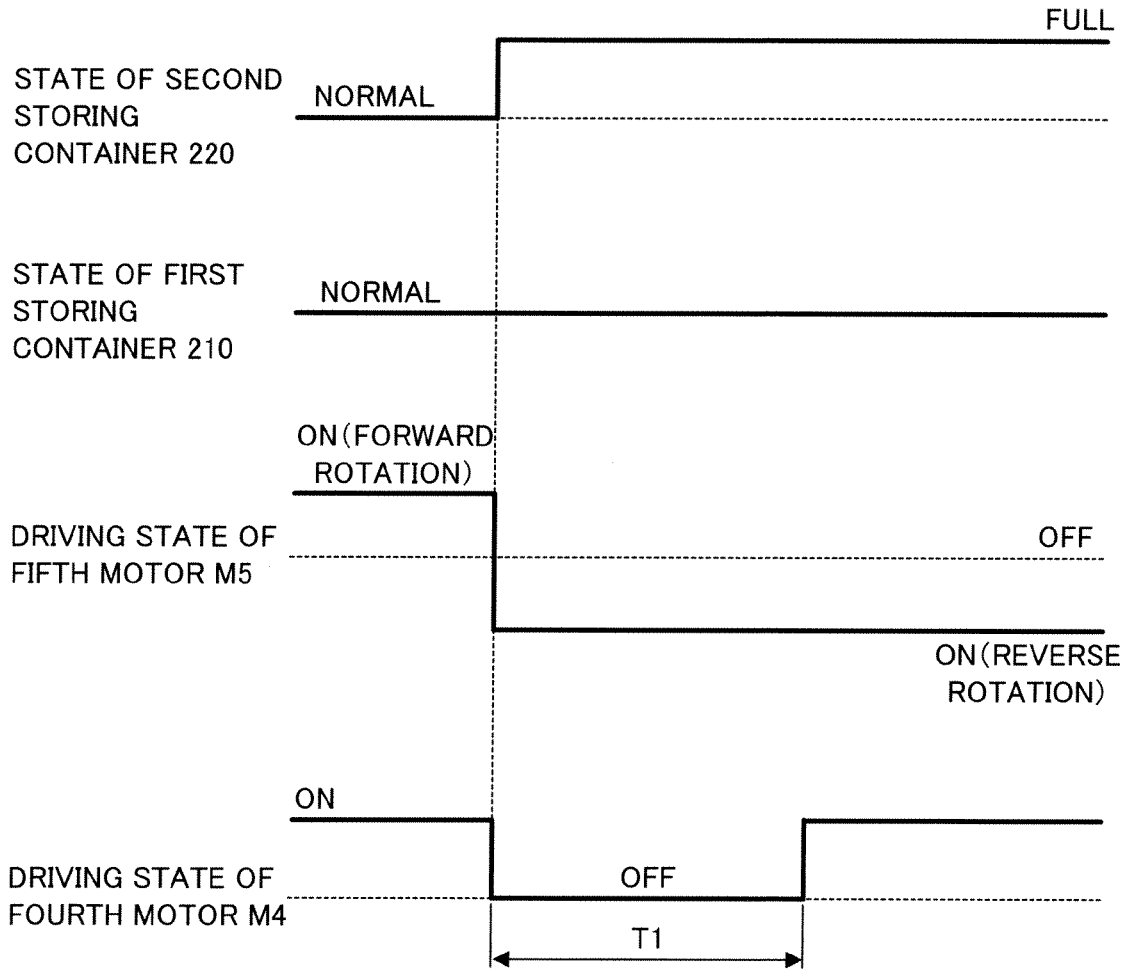
FIG. 6 is a diagram showing an operation sequence of the fourth transporting mechanism and the fifth transporting mechanism.

FIG. 6 is a diagram showing an operation sequence of the fourth transporting mechanism 140 and the fifth transporting mechanism 150. Note that, the operation when the second storing container 220 has been filled up with the waste toner will be described hereinbelow as an example.

As shown in FIG. 6, upon detecting that the second storing container 220 has been filled up with the waste toner on the basis of the output from the fourth sensor S4, the controller 21 reverses the rotation of the fifth motor M5 having been rotating in the forward direction. The transporting member 152 is thus caused to rotate in the reverse direction so as to transport the waste toner received through the receiving port 151C toward the first discharge outlet 151A. In addition, the waste toner located between the receiving port 151C and the second discharge outlet 151B is also transported toward the first discharge outlet 151A. Meanwhile, when detecting that the second storing container 220 has been filled up with the waste toner, the controller 21 stops the driving of the fourth motor M4. As a result, the discharge of the waste toner from the discharge outlet 141A is stopped. In this way, the concentration of the waste toner above or below the receiving port 151C is suppressed. Then, the controller 21 restarts the driving of the fourth motor M4 after a time T1 set in advance passes.

Note that, the driving of the fourth motor M4 may be restarted after the waste toner located between the receiving port 151C and the second discharge outlet 151B passes through the portion below the receiving port 151C. In other words, the above-mentioned time T1 may be set to be not less than a time required for the waste toner located between the receiving port 151C and the second discharge outlet 151B to pass through the portion below the receiving port 151C. Specifically, the driving of the fourth motor M4 may be restarted after the waste toner having reached immediately before the second discharge outlet 151B passes through the portion below the receiving port 151C.

Here, when the driving of the fourth motor M4 is stopped, the waste toner is successively transported by the second transporting mechanism 120 (see FIG. 2) located on the upstream side in the transporting direction. The waste toner thus transported is successively accumulated inside the tubular member 131 (see FIG. 2) in the third transporting mechanism 130. In the present exemplary embodiment, the amount of the waste toner to be transported per unit time in the fourth transporting mechanism 140 is set to be not less than the amount of the waste toner to be transported per unit time in the second transporting mechanism 120. Accordingly, during the normal operation, the waste toner is basically not accumulated inside the tubular member 131. In other words, during the normal operation, the tubular member 131 has enough space for the accumulation of the waste toner. Then, once the driving of the fourth motor M4 is stopped as described above, the waste toner coming from the upstream side in the transporting direction is accumulated inside the tubular member 131. Here, the inside of the tubular member 131 may be taken as an accumulating part in which the waste toner transported from the second transporting mechanism 120 is accumulated.

Note that, although the driving of the fourth motor M4 is stopped in the above-described case, the speed of the fourth motor M4 may be reduced (the rotational speed or output of the fourth motor M4 may be reduced) so as to reduce the amount of the waste toner to be received by the receiving port 151C.

In addition, the operation when the second storing container 220 has been filled up with the waste toner has been described above as an example, however, the same operation as described above, that is, the reversing of the rotation of the fifth motor M5 and the stop of the fourth motor M4, is performed also when the first storing container 210 has been filled up with the waste toner during the transportation of the waste toner to the first storing container 210.

Moreover, the operation when the storing container (the second storing container 220) has been filled up with the waste toner has been described above, however, the same operation as described above, that is, the reversing of the rotation of the fifth motor M5 and the stop of the fourth motor M4, is performed also when the second storing container 220 is removed from the sheet outputting unit 1C, for example. Incidentally, another configuration may be employed, for example, in which a cover member (not illustrated) or the like that is designed to be opened for the removal of the second storing container 220 is provided, and the reversing of the rotation of the fifth motor M5 and the stop of the fourth motor M4 are performed upon detection of the opening of the cover member.

Alternatively, the controller 21 may perform processing as described below.

Figure 7:
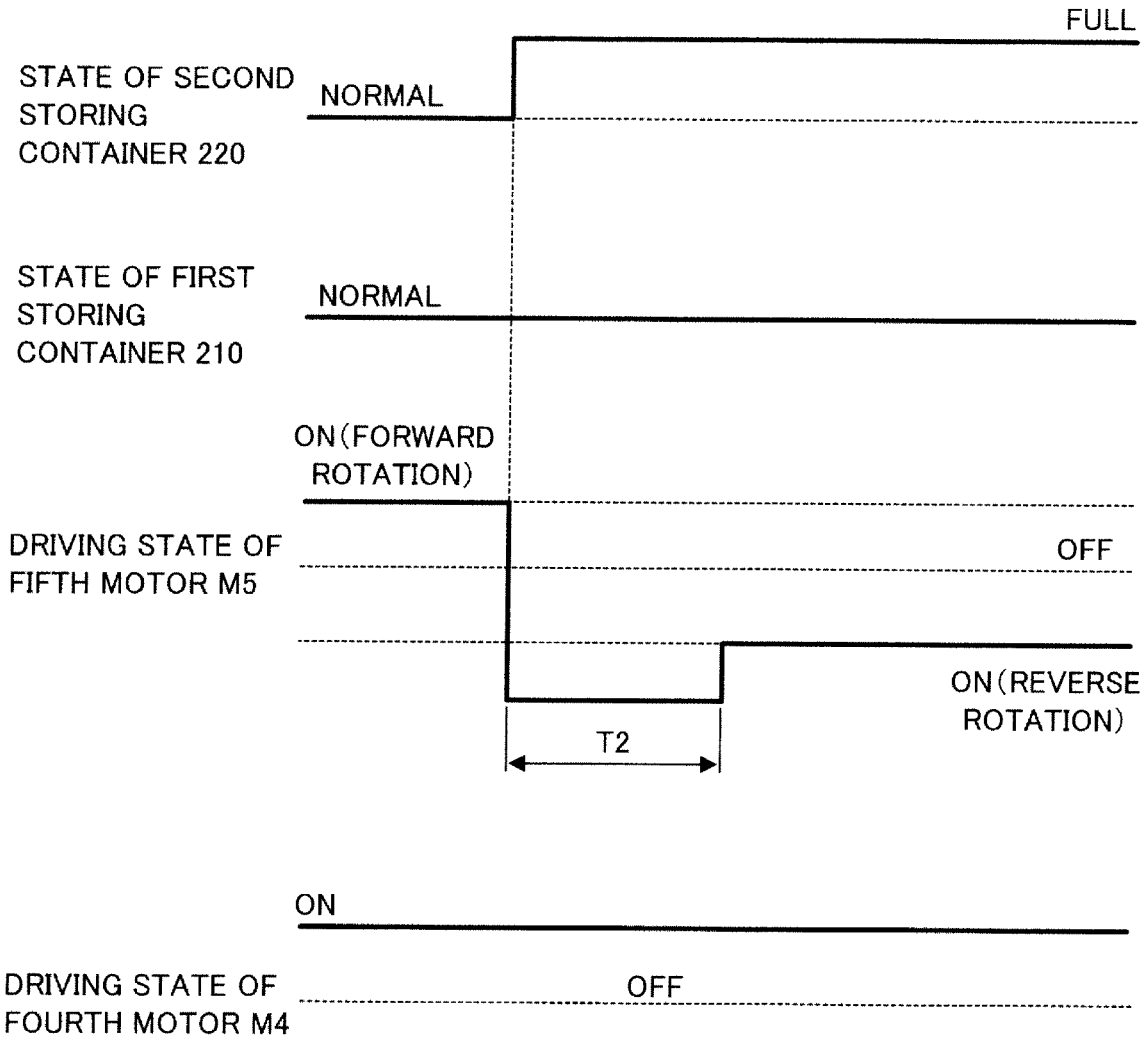
FIG. 7 is a diagram showing another example of the operation sequence of the fourth transporting mechanism and the fifth transporting mechanism.

FIG. 7 is a diagram showing another example of the operation sequence of the fourth transporting mechanism 140 and the fifth transporting mechanism 150.

In the above-described case, the driving of the fourth motor M4 is stopped when the second storing container 220 has been filled up with the waste toner. In contrast, in this processing, while the fourth motor M4 is kept being driven, the rotational speed (output) of the fifth motor M5 is increased above a rotational speed thereof during the normal operation. In other words, the transporting output of the transporting member 152 is increased when the second storing container 220 has been filled up with the waste toner.

Specifically, as shown in FIG. 7, for example, when the fifth motor M5 is rotated in the reverse direction upon detecting that the second storing container 220 has been filled up with the waste toner, the fifth motor M5 is driven at a rotational speed larger than the rotational speed during the normal operation for a time T2. In other words, the rotational speed of the fifth motor M5 rotating in the reverse direction is increased above the rotational speed during the normal operation only for the time T2. On the other hand, the driving of the fourth motor M4 is continued for that period. Then, the driving of the fifth motor M5 at the rotational speed for the normal operation is restarted after the time T2 passes.

In this processing, the waste toner is successively discharged from the discharge outlet 141A. However, since the transporting efficiency (the transporting output) of the transporting member 152 has been increased, the clogging and the like of the waste toner is unlikely to occur as compared with the case where the fifth motor M5 is simply rotated in the reverse direction.

Note that, while the driving of the fourth motor M4 is continued in this processing, the stop of the fourth motor M4 may be further executed as in the processing shown in FIG. 6. Alternatively, the speed of the fourth motor M4 may be reduced (the rotational speed or output of the fourth motor M4 may be reduced) so as to reduce the amount of the waste toner to be discharged from the discharge outlet 141A.

Here, the restart of the driving of the fifth motor M5 at the rotational speed for the normal operation may be performed after the waste toner located between the receiving port 151C and the second discharge outlet 151B passes through the portion below the receiving port 151C. In other words, the above-mentioned time T2 may be set to be not less than a time required for the waste toner located between the receiving port 151C and the second discharge outlet 151B to pass through the portion below the receiving port 151C. Specifically, the restart of the driving of the fifth motor M5 at the rotational speed for the normal operation may be performed after the waste toner having reached immediately before the second discharge outlet 151B passes through the portion below the receiving port 151C.

Meanwhile, in order to further suppress the clogging and the like of the waste toner, the amount of the waste toner to be transported per unit time in the fifth transporting mechanism 150 may be set larger than the amount of the waste toner to be transported per unit time in the fourth transporting mechanism 140. In other words, it may be to satisfy a relation: (the amount of the waste toner to be transported per unit time in the fifth transporting mechanism 150)>(the amount of the waste toner to be transported per unit time in the fourth transporting mechanism 140).

FIGS. 8A, 8B, and 8C are diagrams and an equation for describing the volume of the waste toner transported by the transporting member. FIG. 8A shows a transporting member 200 formed of a resin, while FIG. 8B shows another transporting member 200 having a rotational shaft 201 formed of a metal. In addition, FIG. 8C shows an equation for calculating the volume of the waste toner transported by the transporting member 200.

As indicated by the calculation equation in FIG. 8C, the volume of the waste toner transported by the transporting member 200 increases along with an increase in the rotational speed of the transporting member 200. In addition, the volume of the waste toner transported by the transporting member 200 increases also along with a decrease in a shaft diameter D1 of the rotational shaft 201 of the transporting member 200. Moreover, the volume of the waste toner transported by the transporting member 200 increases along with an increase in a pitch P of ridge portions (fun portions) 202 of the transporting member 200. Further, the volume of the waste toner transported by the transporting member 200 increases along with an increase in an outer diameter D2 of each ridge portion 202 of the transporting member 200. Note that, in the calculation equation, t1 represents the thickness of each ridge portion 202 at its proximal end, and t2 represents the thickness of each ridge portion 202 at its distal end.

Accordingly, the relation: (the amount of the waste toner to be transported per unit time in the fifth transporting mechanism 150)>(the amount of the waste toner to be transported per unit time in the fourth transporting mechanism 140) may be achieved by, for example, making the rotational speed of the transporting member 152 (see FIG. 4) larger than the rotational speed of the transporting member 142. The relation may also be achieved by, for example, making the shaft diameter of the rotational shaft 152A of the transporting member 152 smaller than the shaft diameter of the rotational shaft 142A of the transporting member 142. Alternatively, the relation may be achieved by making the pitch of the ridge portions 152B of the transporting member 152 larger than the pitch of the ridge portions 142B of the transporting member 142. Still alternatively, the relation may also be achieved by, for example, making the outer diameter of each ridge portion 152B of the transporting member 152 larger than the outer diameter of each ridge portion 142B of the transporting member 142.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms an image on a recording medium;

a first storage part that stores waste powder discarded from the image forming section;

a second storage part that stores waste powder discarded from the image forming section;

a transport path through which the waste powder is transported;

a first discharging part that is provided on the transport path and that discharges, to the first storage part, the waste powder having been transported through the transport path;

a second discharging part that is provided on the transport path and that discharges, to the second storage part, the waste powder having been transported through the transport path;

a transporting section that is provided along the transport path so as to extend from the first discharging part to the second discharging part, the transporting section transporting the waste powder in the transport path toward the second discharging part when being in a first operating state, and the transporting section transporting the waste powder in the transport path toward the first discharging part when being in a second operating state;

a feeding section that feeds the waste powder from the image forming section to the transport path at a location between the first discharging part and the second discharging part; and a controller that causes the transporting section to operate in one of the first operating state and the second operating state, and that stops the feeding section or reduces an output of the feeding section when switching a transporting direction of the waste powder by switching an operating state of the transporting section from the first operating state to the second operating state.

2. The image forming apparatus according to claim 1, wherein the transport path includes a receiving part between the first discharging part and the second discharging part, the receiving part receiving the waste powder fed by the feeding section, and the controller restarts driving of the feeding section having been stopped or increases the output of the feeding section having been reduced, after the waste powder, which is located between the receiving part and the second discharging part and is to be transported to the first discharging part, passes through the receiving part.

3. The image forming apparatus according to claim 1, further comprising: a second transporting section that transports the waste powder from the image forming section to the feeding section; and an accumulating part that is provided between the second transporting section and the feeding section, and in which the waste powder transported from the second transporting section is accumulated while the feeding section is stopped or the output of the feeding section is reduced by the controller.

4. The image forming apparatus according to claim 1, wherein an amount of the waste powder to be transported per unit time by the transporting section is larger than an amount of the waste powder to be fed per unit time by the feeding section.

5. An image forming apparatus comprising:

an image forming section that forms an image on a recording medium;

a first storage part that stores waste powder discarded from the image forming section;

a second storage part that stores waste powder discarded from the image forming section;

a transport path through which the waste powder is transported;

a first discharging part that is provided on the transport path and that discharges, to the first storage part, the waste powder having been transported through the transport path;

a second discharging part that is provided on the transport path and that discharges, to the second storage part, the waste powder having been transported through the transport path;

a receiving part that is provided on the transport path between the first discharging part and the second discharging part and that receives the waste powder from the image forming section;

a transporting section that is provided along the transport path so as to extend from the first discharging part to the second discharging part, the transporting section transporting the waste powder in the transport path to the second discharging part in a first operating state, and the transporting section transporting the waste powder in the transport path to the first discharging part in a second operating state; and a controller that causes the transporting section to operate with an output set in advance, and that causes the transporting section in the second operating state to operate with a larger output than the output set in advance when switching an operating state of the transporting section from the first operating state to the second operating state.

6. The image forming apparatus according to claim 5, wherein the controller reduces the output of the transporting section having been caused to operate with the larger output, after the waste powder, which is located between the receiving part and the second discharging part and is to be transported to the first discharging part, passes the receiving part.

7. The image forming apparatus according to claim 5, further comprising a feeding section that feeds the waste powder from the image forming section to the transport path through the receiving part, wherein the controller further causes the feeding section to stop or the output of the feeding section to reduce, when switching the operating state of the transporting section from the first operating state to the second operating state.

8. The image forming apparatus according to claim 5, wherein the controller switches the operating state of the transporting section from the first operating state to the second operating state when the second storage part is filled up with the waste powder or when an operation set in advance is executed for removal of the second storage part.

9. A powder transporting apparatus comprising:

a transport path through which powder is allowed to be transported in one direction and in an opposite direction to the one direction;

a transporting member that has one end and other end and is provided along the transport path, the transporting member transporting the powder in the one direction in a first operating state and transporting the powder in the opposite direction in a second operating state;

a feeding section that feeds the powder to the transporting member at a location between the one end and the other end of the transporting member; and a controller that causes the transporting member to operate in one of the first operating state and the second operating state, and that stops the feeding section or reduces an output of the feeding section when switching a transporting direction of the powder by switching an operating state of the transporting member from the first operating state to the second operating state.

10. A powder transporting apparatus comprising:

a transport path through which powder is allowed to be transported in one direction and in an opposite direction to the one direction;

a transporting member that has one end and other end and is provided along the transport path, the transporting member transporting the powder in the one direction in a first operating state and transporting the powder in the opposite direction in a second operating state;

a feeding section that feeds the powder to the transporting member at a location between the one end and the other end of the transporting member; and a controller that causes the transporting member to operate with an output set in advance, and that causes the transporting member in the second operating state to operate with an output larger than the output set in advance when switching an operating state of the transporting member from the first operating state to the second operating state.

11. A waste-powder transporting method of an image forming apparatus including: an image forming section that forms an image on a recording medium, a first storage part that stores waste powder discarded from the image forming section, a second storage part that stores waste powder discarded from the image forming section, and a transport path through which the waste powder is transported, the waste-powder transporting method comprising:

discharging, from a first discharging part that is provided on the transport path to the first storage part, the waste powder having been transported through the transport path;

discharging, from a second discharging part that is provided on the transport path to the second storage part, the waste powder having been transported through the transport path;

transporting the waste powder in the transport path toward the second discharging part when being in a first operating state, and transporting the waste powder in the transport path toward the first discharging part when being in a second operating state;

feeding the waste powder from the image forming section to the transport path at a location between the first discharging part and the second discharging part; and causing a transporting section to operate in one of the first operating state and the second operating state, and stopping the feeding of the waste powder or reducing an output of the feeding of the waste powder when switching a transporting direction of the waste powder by switching an operating state of the transporting section from the first operating state to the second operating state.

* * * * *